US008695584B2

(12) United States Patent
Boeckler et al.

(10) Patent No.: US 8,695,584 B2
(45) Date of Patent: Apr. 15, 2014

(54) OVEN, ESPECIALLY DOMESTIC OVEN

(75) Inventors: Marco Boeckler, Rothenburg o. d. Tauber (DE); Tobias Weber, Burk (DE); Willi Kranz, Schnelldorf (DE); Trevor Specht, Ansbach (DE); Bernd Heisswolf, Rothenburg o. d. Tauber (DE)

(73) Assignee: Electrolux Home Products Corporation N.V., Brussels (BE)

( * ) Notice: Subject to any disclaimer, the term of this patent is extended or adjusted under 35 U.S.C. 154(b) by 0 days.

(21) Appl. No.: 13/395,724

(22) PCT Filed: Oct. 20, 2010

(86) PCT No.: PCT/EP2010/006402

§ 371 (c)(1),
(2), (4) Date: Mar. 13, 2012

(87) PCT Pub. No.: WO2011/047845

PCT Pub. Date: Apr. 28, 2011

(65) Prior Publication Data

US 2012/0199112 A1 Aug. 9, 2012

(30) Foreign Application Priority Data

Oct. 22, 2009 (EP) ..... 09013331

(51) Int. Cl.
*F24C 3/02* (2006.01)

(52) U.S. Cl.
USPC ..... 126/273 R; 126/19 R

(58) Field of Classification Search
USPC ..... 126/19 R, 273 R
See application file for complete search history.

(56) References Cited

U.S. PATENT DOCUMENTS 1,771,145 A 7/1930 Sadwith
2,175,954 A 10/1939 Cook (Continued)

FOREIGN PATENT DOCUMENTS

DE 1734723 11/1956
DE 957783 2/1957

(Continued)

OTHER PUBLICATIONS

International Search Report for PCT/EP2010/006402, dated Mar. 1, 2011, 3 pages.

*Primary Examiner* — Kenneth Rinehart
*Assistant Examiner* — Gajanan M Prabhu
(74) *Attorney, Agent, or Firm* — Pearne & Gordon LLP

(57) ABSTRACT

The invention relates to a domestic oven (1), having a cavity (2) and a carrier structure (3, 4) connected with the cavity (2), wherein the carrier structure (3, 4) comprises at least two side panels (3) arranged in the side regions (5) of the oven (1) and a component plate (4), wherein the component plate (4) is connected with the side panels (3), wherein the side panels (3) extend in vertical direction (V) and in a first horizontal direction (H) and wherein the component plate (4) extends in a horizontal transverse direction (T) perpendicular to the first horizontal direction (H). To eliminate tensions in the carrier structure due to thermal expansion in an easy and cheap way, the invention is characterized in that the component plate (4) has at least one carrier extension (6) extending in transverse direction (T) which extends in a corresponding first opening (7) with at least one bearing surface (8) in the side panel (3), so that a relative movement in transverse direction (T) is allowed between the side panel (3) and the component plate (4).

17 Claims, 3 Drawing Sheets

(56) References Cited

U.S. PATENT DOCUMENTS

| | | | | |
|---|---|---|---|---|
| 2,622,584 | A | 12/1952 | Reeves | |
| 2,767,298 | A * | 10/1956 | Fry | 219/395 |
| 5,475,958 | A | 12/1995 | Josefsson et al. | |
| 6,242,724 | B1 * | 6/2001 | Lee | 219/756 |
| 2006/0243266 | A1 | 11/2006 | Schmitz | |
| 2008/0296292 | A1 * | 12/2008 | Byun | 219/680 |

FOREIGN PATENT DOCUMENTS

| | | | | |
|---|---|---|---|---|
| DE | 2106775 | | 8/1972 | |
| DE | 10314589 | | 10/2004 | |
| DE | 102006004378 | | 8/2007 | |
| EP | 1464895 | | 10/2004 | |
| EP | 1464895 | A1 * | 10/2004 | F24C 15/08 |
| GB | 1047386 | | 11/1966 | |

* cited by examiner

OVEN, ESPECIALLY DOMESTIC OVEN

The invention relates to an oven, especially to a domestic oven, having a cavity and a carrier structure connected with the cavity, wherein the carrier structure comprises at least two side panels arranged in the side regions of the oven and a component plate, wherein the component plate is connected with the side panels, wherein the side panels extend in vertical direction and in a first horizontal direction and wherein the component plate extends in a horizontal transverse direction perpendicular to the first horizontal direction.

Domestic ovens of this kind are well known in the art. An examples is shown in DE 103 14 589 A1. Similar solutions are known from DE 21 06 775 B, from GB 1 047 386 and from DE 17 34 723 U1.

Normally, the connection between the component plate and the side panels is established as screw connection, i. e. as a firm connection. As thermal tensions could come into being during the heating of the cavity, the component plate is designed as a flexible element. This allows to compensate a thermal expansion during the use of the oven by a deformation of the component plate. On the other hand, the component plate is not able to transmit forces, so the component plate does make no contribution to the transverse stiffness of the oven. It is aimed that the stiffness of the oven is improved by a design of the component plate which allows the transmittal of higher forces. On the other hand if the component plate is arranged as a stiff part in the oven frame it is possible that relative movements of the structure due to thermal expansions lead to high tensions in the structure. This can cause brakes in the part; furthermore a detrimental spalling of an enamel coating becomes possible.

Thus, it is an object of the present invention to design an oven, especially a domestic oven, in such a way that internal tensions in the frame structure of the oven are minimized which are caused by thermal expansion. Consequently, breaks and spallings of an enamel coating should be prevented. It is also a relevant aspect that this is reached with cheap measures.

The solution of this object according to the invention is characterized in that the component plate has at least one carrier extension extending in transverse direction which extends in a corresponding first opening with at least one bearing surface in the side panel, so that a relative movement in transverse direction is allowed between the side panel and the component plate.

Preferably, the carrier extension and the first opening have a rectangular cross section seen in transverse direction. The component plate can further have connecting means for connecting the component plate and the side panel. The connecting means can be cooperating in a form-fitted manner with the side panel. They can comprise at least one elastic element which penetrates a second opening in the side panel and which forms a snap-on connection with the side panel.

The connecting means preferably comprise two elastic elements which penetrates the second opening, wherein the two elastic elements extent in a direction perpendicular to the transverse direction, wherein the two elastic elements are turned away from another. The second opening in the side panel can have at least partially a circular shape.

The first opening and the second opening are preferably connected. In this case the shape of the two adjacent openings is preferably that one of a keyhole.

The cavity and the component plate are preferably firmly connected. The firm connection can be a screw connection in a preferred embodiment.

The cavity and the side panels can be firmly connected via a bracket. The connection is also here preferably a screw connection. The bracket is preferably arranged in a bottom region of the oven.

A fan can be arranged on the component plate.

The component plate can be arranged in a top region of the oven.

In an advantageous manner it becomes possible with the proposed design that thermal expansion during the use of the oven is compensated in the transverse horizontal direction as a floating bearing function is established between the component plate and the side panels. The compensation between the component plate and the side panels is established as a relative movement between the mentioned parts is possible within certain limitations. The component plate is firmly connected with the cavity, but a relative movement can take place between the component plate and the side panel.

Thus, thermal stress in the frame structure is kept to a minimum. Breaks and spallings cannot occur.

A further advantage is that a fan and more specifically a fan motor which is arranged on the component plate is not influences by thermal expansion. A tense up of the shaft of the motor of the fan between the cavity and the component plate cannot occur as it is the case in pre-known solutions.

The stiffness in horizontal transverse direction of the frame structure is higher than in pre-known solutions when—as it is preferred—the component plate is designed as a stiff element.

A further benefit of the proposed design is that a very simple mounting process can be employed as the component plate and the side panels can be connected without any further connection means. The snap-on connection between the component plate and the side panel allows an easy joint of the parts and no connections elements like screws and the like are necessary.

In the drawings an embodiment of the invention is depicted.

Figure 3:
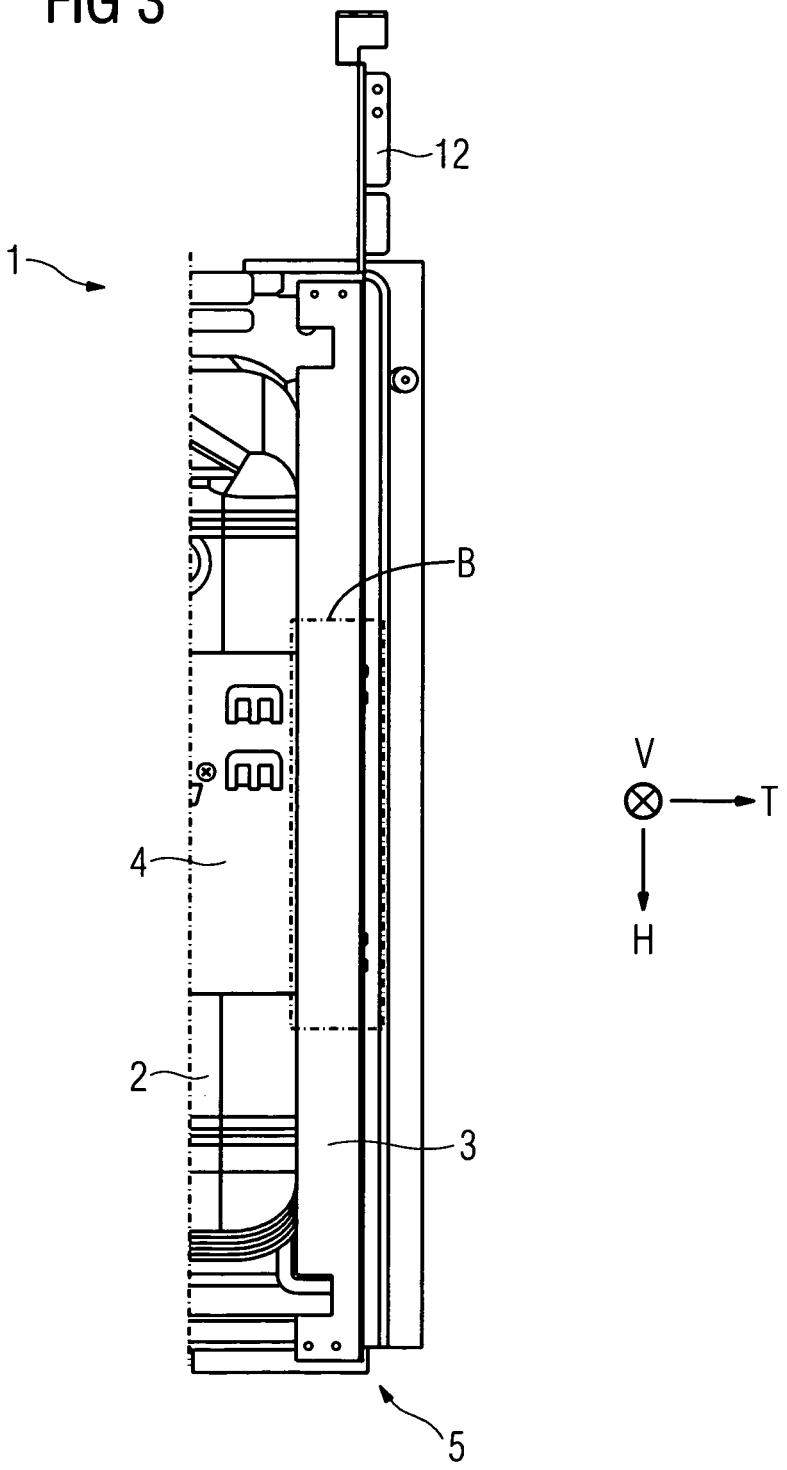
FIG. 3 shows the top plan view of the domestic oven according to FIG. 1, wherein only a side region of the oven is depicted.

In the figures an oven 1 and part of it are shown. The oven 1 has a cavity 2 which is held by a carrier structure 3, 4. This carrier structure consists of two side panels 3 and a component plate 4. The side panels 3 extend in the vertical direction V and in a first horizontal direction H. The component plate 4 (see FIG. 3) extends substantially in a horizontal transverse direction T which is perpendicular to the first horizontal direction H. The side panels 3 are arranged in both side regions 5 of the oven. The component plate 4 is arranged in a top region 15 of the oven 1. To further stiffen the carrier structure 3, 4 a bracket 12 is connected to the structure, which is arranged in a bottom region 13 of the oven 1.

A fan 14 with a fan motor is arranged onto the component plate 4.

Figure 1:
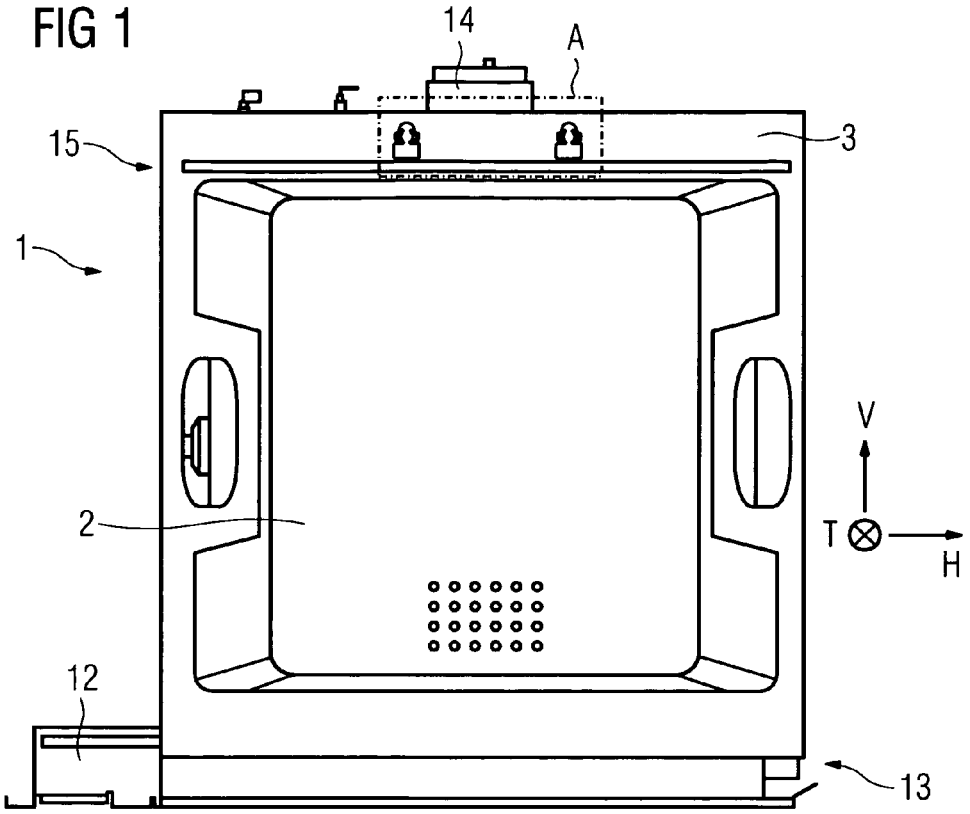
FIG. 1 shows a side view of a domestic oven.
Figure 2:
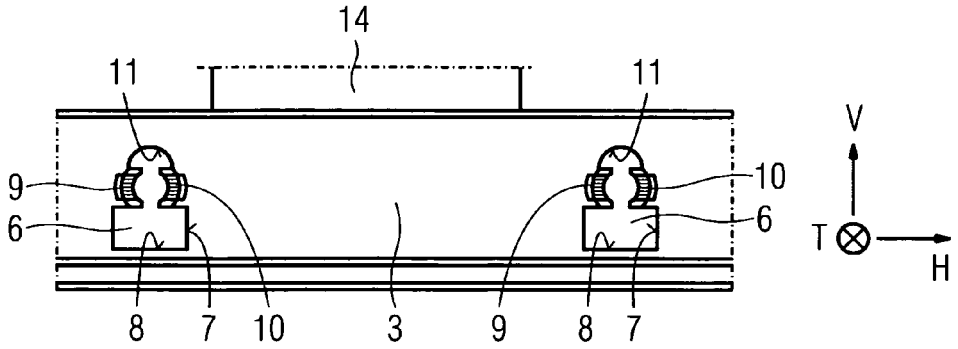
FIG. 2 shows the detail "A" according FIG. 1.

To allow thermal expansions which occur during the use of the oven 1 to be compensated the component plate 4 has at both end sides two carrier extensions 6. Those extensions extend in the transverse direction T. The extensions 6 extend into a corresponding first opening 7 in the side panel 3. As can be seen best in FIG. 2, the first opening 7 has a bearing surface 8. Consequently, the extension 6 can slide in transverse direction T within the first opening 7 on the bearing surface 8. So a relative movement in transverse direction T is allowed between the side panel 3 and the component plate 4.

Figure 4:
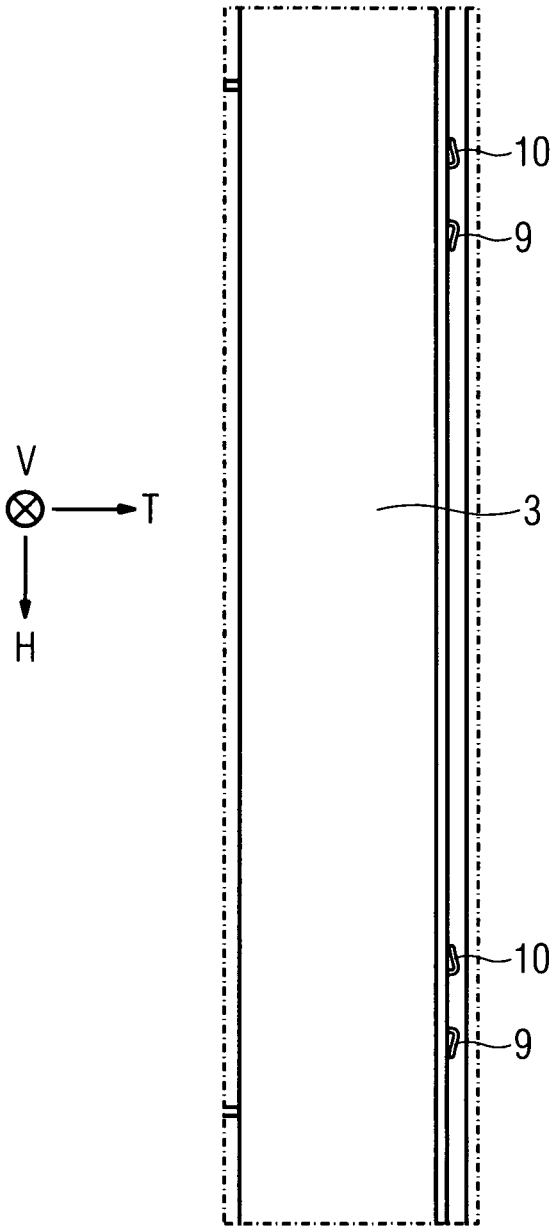
FIG. 4 shows the detail "B" according FIG. 3.

For a form-fitted connection between the component plate 4 and the side panel 3 connection means 9, 10 are arranged. The connection means 9, 10 are two elastic elements which are deformed from the material of the component plate 4 in such a way that they are turned away from another and extend in a direction perpendicular to the transverse direction T, i. e. in the horizontal direction H. As can be seen best in FIG. 4 in the synopsis with FIG. 2, the elastic elements 9, 10 reach through a second opening 11 in the side panel 3 and snap behind the surface of the side panel 3 (see FIG. 4). So, a firm connection between the component plate 4 and the side panels 3 is established which allows a certain relative movement in transverse direction T.

The component plate 4 and the bracket 12 are already connected by means of screws before the side panels 3 are mounted. The component plate 4 and the bracket 12 are firmly connected with the cavity 2. Then the side panels 3 are mounted by means of the keyhole-like opening 7, 11 in the side panel 3 in which the carrier extension 6 and the elastic elements 9, 10 are inserted. The side panels 3 are then firmly connected by screws with the bracket 12.

So, the side panels 3 are firmly connected in horizontal and vertical direction with the unit comprising the cavity 2, the component plate 4 and the bracket 12 in a bottom region 13 of the oven.

On the other hand the connection between the side panels 3 and the component plate 4 is designed as a floating bearing connection in the top region 15 of the oven 1.

By this design a floating bearing function is established. The component plate 4 together with the fan 14 and its motor can move relatively to the side panels 3 and thus thermal expansions are eliminated which occur during heating up and down of the cavity.

The keyhole-like openings 7, 11 can be machined by a punching process in a cost efficient manner. Also the carrier extensions 6 and the elastic elements 9, 10 can be machined from a sheet metal plate by punching and deforming.

REFERENCE NUMERALS

1 Oven
2 Cavity
3, 4 Carrier structure
3 Side panel
4 Component plate
5 Side region
6 Carrier extension
7 First opening
8 Bearing surface
9, 10 Connecting means
9 Elastic element
10 Elastic element
11 Second opening
12 Bracket
13 Bottom region
14 Fan
15 Top region
V Vertical direction
H First horizontal direction
T Transverse direction The invention claimed:

1. Domestic oven (1), having a cavity (2) and a carrier structure (3, 4) connected with the cavity (2), wherein the carrier structure (3, 4) comprises at least two side panels (3) arranged in the side regions (5) of the oven (1) and a component plate (4), wherein the component plate (4) is connected with the side panels (3), wherein the side panels (3) extend in vertical direction (V) and in a first horizontal direction (H) and wherein the component plate (4) extends in a horizontal transverse direction (T) perpendicular to the first horizontal direction (H) , characterized in that the component plate (4) has at least one carrier extension (6) extending in the horizontal transverse direction (T) which extends in a corresponding first opening (7) with at least one bearing surface (8) in the side panel (3), so that a relative movement in the horizontal transverse direction (T) is allowed between the side panel (3) and the component plate (4).

2. Oven according to claim 1, characterized in that the carrier extension (6) and the first opening (7) have a rectangular cross section seen in transverse direction (T).

3. Oven according to claim 1 , characterized in that the component plate (4) further has connecting means (9, 10) for connecting the component plate (4) and the side panel (3).

4. Oven according to claim 3, characterized in that the connecting means (9, 10) are cooperating in a form-fitted manner with the side panel (3).

5. Oven according to claim 4, characterized in that the connecting means (9, 10) comprise at least one elastic element which penetrates a second opening (11) in the side panel (3) and which forms a snap-on connection with the side panel (3).

6. Oven according to claim 5, characterized in that the connecting means (9, 10) comprise two elastic elements which penetrates the second opening (11), wherein the two elastic elements (9, 10) extend in a direction perpendicular to the transverse direction (T), wherein the two elastic elements (9, 10) are turned away from another.

7. Oven according to claim 5, characterized in that the second opening (11) in the side panel (3) has at least partially a circular shape.

8. Oven according to claim 5, characterized in that the first opening (7) and the second opening (11) are connected.

9. Oven according to claim 1, characterized in that the cavity (2) and the component plate (4) are firmly connected by a connection.

10. Oven according to claim 9, characterized in that the connection is a screw connection.

11. Oven according to claim 1, characterized in that the cavity (2) and the side panels (3) are firmly connected by a connection via a bracket (12).

12. Oven according to claim 11, characterized in that the connection is a screw connection.

13. Oven according to claim 11, characterized in that the bracket (12) is arranged in a bottom region (13) of the oven (1).

14. Oven according to claim 1, characterized in that a fan (14) is arranged on the component plate (4).

15. Oven according to claim 1, characterized in that the component plate (4) is arranged in a top region (15) of the oven (1).

16. A domestic oven, comprising:

a cavity;

a carrier structure connected to the cavity, wherein the carrier structure comprises at least two side panels arranged in side regions of the oven and extending in vertical direction (V) and in a first horizontal direction (H), and a component plate connected with the side panels and arranged in a top region of the oven extending in a horizontal transverse direction (T) perpendicular to the first horizontal direction (H), wherein the component plate includes a fan arranged on the component plate and at least one carrier extension extending in the horizontal transverse direction (T) which extends in a corresponding first opening with at least one bearing surface in the side panel, so that a relative movement in the horizontal transverse direction (T) is allowed between the side panel and the component plate, wherein the carrier extension and first opening have a rectangular cross section seen in transverse direction, and wherein the component plate further includes connecting means for connecting the component plate and the side panel that comprise at least one elastic element which penetrates a second opening connected to the first opening in the side panel and extends in a direction perpendicular to the horizontal transverse direction (T) and which forms a snap-on connection with the side panel.

17. The domestic oven according to claim 1 wherein the component panel is configured to be movable relative to the cavity.

* * * * *